US007681641B2

(12) United States Patent
Mudry

(10) Patent No.: US 7,681,641 B2
(45) Date of Patent: Mar. 23, 2010

(54) PLUNGER LIFT CONTROLLER AND METHOD

(75) Inventor: David Daniel Mudry, Lewisville, TX (US)

(73) Assignee: Vinson Process Controls Company, LP, Lewisville, TX (US)

( * ) Notice: Subject to any disclaimer, the term of this patent is extended or adjusted under 35 U.S.C. 154(b) by 132 days.

(21) Appl. No.: 11/972,555

(22) Filed: Jan. 10, 2008

(65) Prior Publication Data

US 2008/0202746 A1 Aug. 28, 2008

Related U.S. Application Data

(60) Provisional application No. 60/892,130, filed on Feb. 28, 2007.

(51) Int. Cl.
*E21B 43/00* (2006.01)
*G05D 11/00* (2006.01)

(52) U.S. Cl. ..... 166/250.15; 166/53; 166/369; 166/372; 700/282

(58) Field of Classification Search ..... 166/53, 166/66.6, 250.15, 369, 372; 700/282
See application file for complete search history.

(56) References Cited

U.S. PATENT DOCUMENTS

| | | | | |
|---|---|---|---|---|
| 5,146,991 | A | 9/1992 | Rogers | |
| 5,878,817 | A | 3/1999 | Stastka | |
| 5,957,200 | A | 9/1999 | Majek et al. | |
| 6,241,014 | B1 | 6/2001 | Majek et al. | |
| 6,595,287 | B2 * | 7/2003 | Fisher | 166/250.15 |
| 6,883,606 | B2 * | 4/2005 | Evans et al. | 166/250.15 |
| 2005/0061516 | A1 * | 3/2005 | West | 166/369 |
| 2006/0052903 | A1 * | 3/2006 | Bassett | 700/282 |
| 2007/0012442 | A1 * | 1/2007 | Hearn | 166/250.15 |
| 2007/0261845 | A1 * | 11/2007 | White et al. | 166/250.15 |
| 2008/0023203 | A1 * | 1/2008 | Steiner | 166/312 |

* cited by examiner

*Primary Examiner*—David J Bagnell
*Assistant Examiner*—Michael Wills, III
(74) *Attorney, Agent, or Firm*—Henry L. Ehrlich; Winstead PC

(57) ABSTRACT

A method of controlling a plunger lift system for a well. The method including the steps of: defining a threshold value for a trigger event, the trigger event initiating operation of the control valve by the controller; defining event-value conditions upon which adjustment of the trigger event is adjusted; determining, upon a calling-event, if the event-value conditions have been satisfied; and adjusting the trigger event threshold value upon satisfaction of the event-value conditions.

15 Claims, 5 Drawing Sheets

PLUNGER LIFT CONTROLLER AND METHOD

RELATED APPLICATIONS

This application claims the benefit of U.S. Provisional Patent Application No. 60/892,130 filed Feb. 28, 2007.

TECHNICAL FIELD

The invention relates to the control of oil and gas wells using a plunger lift device and more particularly to adjustable control of such wells.

BACKGROUND

There will come a time during the life of most production wells in which the bottomhole pressure and gas to liquid ratio will not support natural flow. At this stage some form of artificial lift must be selected to remove liquids from the well so that production can continue.

One form of artificial lift entails repetitively closing in the well to allow pressure to buildup as liquid flows into the well. When a compatible combination of pressure and liquid accumulation is reached the well is opened and the liquid can be produced to a sales line and/or tank. Intermitting techniques include time based cycling and event based cycling. Time based cycling is based solely on a clock. The well is set to be flowing for a certain period of time and then shut-in for a certain number of hours. Event based cycling, optimization, is a method where certain inputs, such as pressures, flow rate, or differential pressure are set at a threshold value. When the threshold value is crossed an event occurs such as opening the well or shutting the well in. "Open triggers" are thresholds that trigger opening the well and "close triggers" are thresholds that trigger closing the well.

Plunger lift systems use intermitting techniques in combination with a free traveling plunger in the tubing string that provides an interface between the liquid phase and the gas phase. Use of a plunger facilitates operating the well at a lower flowing bottomhole pressure than non-plunger intermitting techniques, thereby enhancing well production.

In a typical plunger lift system, the well is completed with casing, tubing and a control valve. A sales line connects the control valve to the remainder of the gas distribution system and a sales meter is connected to the sales line for measuring the amount of gas that has passed through the sales line. Gas enters the well from the surrounding formation through perforations in the casing. Closing the control valve has the effect of allowing pressure inside the casing to increase. The tubing extends from the valve to near the bottom of the casing. A plunger is positioned on a bumper spring at or near the bottom of the tubing. After a fixed amount of time has past, or after the casing pressure or another trigger has crossed a particular threshold value, the valve is automatically opened and the plunger is forced upward due to the built up pressure inside the casing. Ideally, opening of the valve in this manner allows the gas, as well as any oil and water, to be forced up the tubing by the plunger. As long as the valve is open, more gas, and in many instances oil and water, flow into the tubing below the plunger. Once the plunger reaches the top of the tubing, gas flows through or past the plunger into a line. After a fixed amount of time has past, or after the casing pressure or another trigger crosses a particular threshold value, the valve is closed and the plunger returns back down the tubing, through the liquid, to stop on the bumper spring at or near the bottom of the tubing.

In many plunger systems a controller senses the gas pressure in the casing and opens the valve when the pressure exceeds a fixed value or a fixed amount of time has past. These plunger systems have a number of problems in the production of natural gas. If a controller blindly opens the valve when the casing pressure is deemed sufficient, or after a fixed amount of time has past since the last cycle, the valve may either be opened too early or too late in the cycle to optimize gas production. If the valve is opened too early, the pressure in the casing is insufficient to force the plunger to completely lift the water and oil out of the well. If this continues it can result in the well loading up with oil and water and shutting-in. In this case, gas production continues to decrease until it ceases, causing an interruption in gas production and a corresponding loss of revenues derived from that well.

In the situation where the valve is opened too late, excessive pressures can build up behind the plunger, forcefully impacting the plunger against the top of the casing and potentially causing damage. Even if no damage is done, waiting too long between opening the valve after each cycle means less gas is produced from the well, resulting in a corresponding loss of revenues derived from that well. In addition, when excessive pressure builds in the casing, the corresponding pressure differential between the tubing line pressure and the sales line pressure becomes great. In this situation when the valve is opened and the plunger rises at high speeds, the gas flow in the sales line exceeds the maximum measurable by the sales meter. Of course, there is a corresponding loss of revenues derived from the well when quantities of gas flow from the well into the sales line without being registered on the sales meter.

The characteristics of even a once perfectly tuned system change over time, causing the interval between opening the valve to be less than optimal. Accordingly, it is desirable to control a well plunger system in a manner that compensates for changing characteristics of the well.

SUMMARY

An example of a method of controlling a plunger lift system for a well wherein the plunger lift system has a tubing positioned in a cased well, a plunger in the tubing moveable from the bottom of the tubing to a top of the tubing, a control valve in functional connection with the tubing, a plunger arrival sensor, a tubing pressure sensor, a casing pressure sensor, and a sales line pressure sensor, a controller in operational connection with the control valve and in functional connection with the sensors for receiving signals from the sensors, includes the steps of: defining a threshold value for a trigger event, the trigger event initiating operation of the control valve by the controller; defining event-value conditions upon which adjustment of the trigger event threshold value is adjusted; determining, upon a calling-event, if the event-value conditions have been satisfied; and adjusting the trigger event threshold value upon satisfaction of the event-value conditions.

The foregoing has outlined some of the features and technical advantages of the present invention in order that the detailed description of an example of the invention that follows may be better understood. Additional features and advantages will be described hereinafter which form the subject of the claims.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
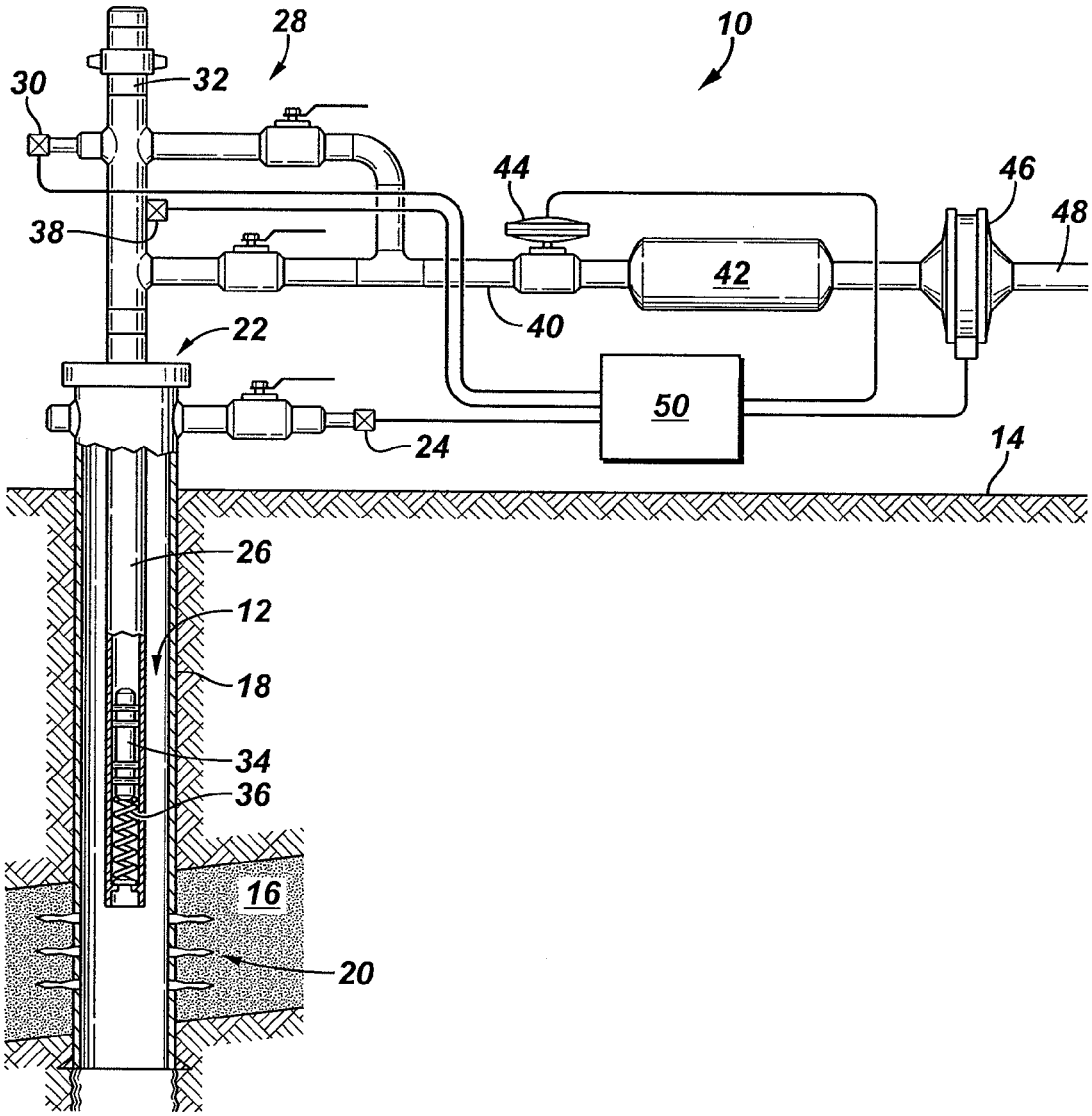
FIG. 1 is a schematic illustration of a well system utilizing an example of a self-adjusting controller of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic of an embodiment of a plunger lift system of the present invention, generally denoted by the numeral 10. A well or wellbore 12 extends from the surface 14 to a subterranean reservoir formation 16. Wellbore 12 is lined with a casing 18 having perforations 20 proximate to formation 16. The top of casing 18 is closed at a wellhead 22. A casing pressure transducer 24 is mounted proximate to wellhead 22 for monitoring the pressure within casing 18.

A tubing string 26 extends from wellhead 22 down casing 18. Tubing 26 is connected at the surface to a production tee generally denoted by the numeral 28. A tubing pressure transducer 30 is in operational connection with tubing 26 for monitoring the pressure within tubing 26. Production tee 28 includes a lubricator or plunger catcher 32.

A plunger 34 is positioned within tubing 26 for lengthwise travel from a spring assembly 36 positioned proximate the bottom of tubing 26 and catcher 32 of the production tee 28. A plunger sensor 38 at production tee 28 detects the arrival of plunger at the top of tubing 26 and produces a corresponding electrical signal.

Extending from production tee 28 and tubing 26 is a production line 40. Production line 40 extends through a production separator 42 that separates the gas from the liquid fractions. Control valve 44 is positioned within production line 40. As is well known in the art, control valve 44 may be positioned in various locations within line 40. Control valve 44 is illustrated as an electromechanical motor valve, however other types of controllable valves may be utilized. Continuing downstream is sales meter 46 and sales line 48.

A controller 50 is provided in operational connection with control valve 44. Controller 50 is further in functional connection with casing pressure transducer 24, tubing pressure transducer 30, plunger arrival sensor 38, and sales meter 46, and other sensors for receiving electrical signals. The system further include a pressure sensor in connection with the sales line for sending a signal corresponding to the pressure to the controller. Sales meter 46 may include the means for transmitting a pressure signal to controller 50. Controller 50 is a microprocessor that can receive the various inputs, perform the calculations and provide an output to control a valve as described herein. Controller 50 receives electrical signals from a variety of sources including transducers 24, 30, the pressure sensor at sales line meter 46, and measured flow rates in the system. Additionally, controller 50 may calculate data, such as flow rates, from signals received at various locations within the system.

Controller 50 includes a central processing unit (CPU), a clock, and a number of other units interconnected via a system bus. Controller 50 may also include an I/O adapter for connecting peripheral devices such as disk units and tape drives to the bus, a user interface adapter for connecting a keyboard, a mouse and/or other user interface devices such as a touch screen device to the bus, a communication adapter for connecting the data processing system to a data processing network, and a display adapter for connecting the bus to a display device which may include sound. The CPU may include other circuitry such an execution unit, a bus interface unit, an arithmetic logic unit and other microprocessor circuitry. The CPU may reside on a single integrated circuit. Read-only memory may be coupled to the system bus and include a basic input/output system that controls certain basic functions. Random access memory may also be coupled to the system bus. Software components, including the operating system and application, may be loaded into the memory. Controller 50 may further include a communications adapter coupled to the bus. The communications adapter may interconnect the bus with an outside network, e.g., Local Area Network (LAN), Wide Area Network (WAN), enabling controller 50 to communicate with other such systems. Data may be inputted to controller 50 through any of these devices by an operator or the various sensors and transmitters in the system.

Figure 2A:
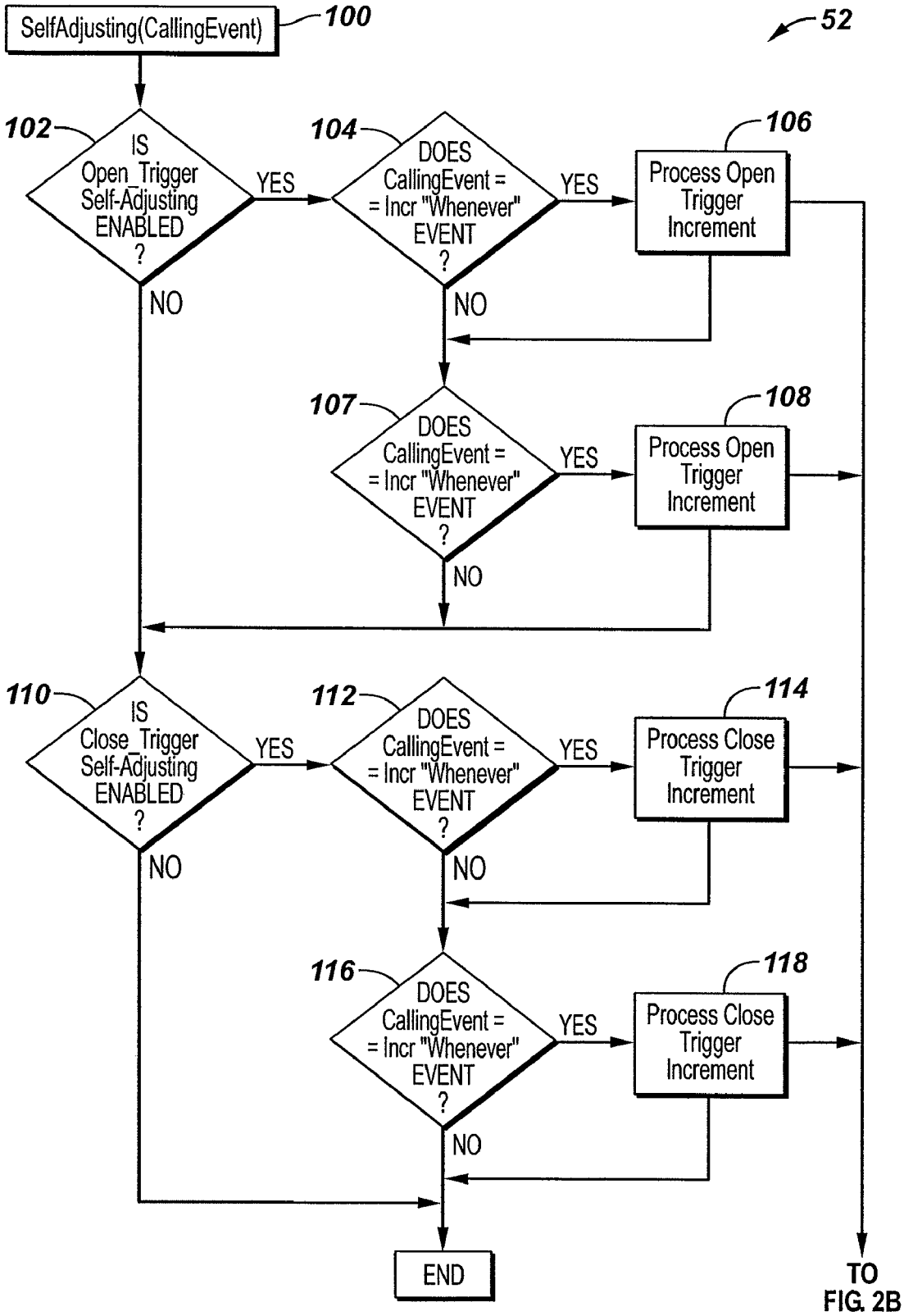
FIG. 2A-2B is a flow chart of an example of a process for controlling a plunger lift system of the present invention.
Figure 2B:
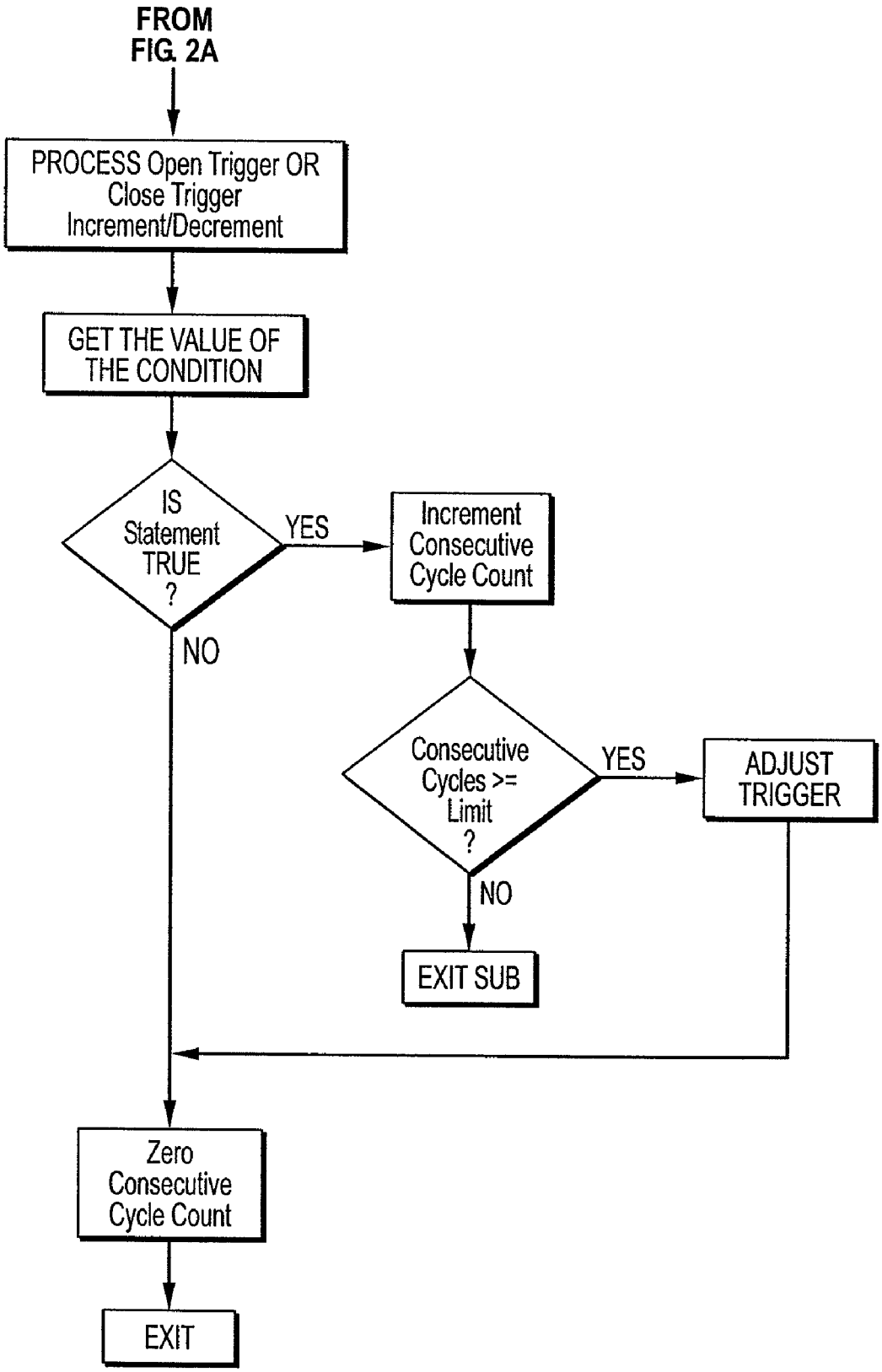

Referring now to FIGS. 2A and 2B wherein flow charts of an example of a trigger self-adjusting routine, generally denoted by the numeral 52, showing some of the steps performed by controller 50 is provided.

Controller 50 operates control valve 44 between the closed position and the open position to cycle plunger 34. Upon opening of valve 44, plunger 34 is lifted from assembly 36 lifting the liquid fraction in tubing 26 to the surface. Upon arrival of plunger 34 at the surface, the well produces gas. Upon closing valve 44, plunger 34 is dropped back down tubing 26. These events are referred to herein as calling-events. The three calling-events are: 1) opening of valve 44; 2) closing of valve 44; and 3) arrival of plunger 34. The "arrival" calling-event includes actual arrival of plunger 34 at the surface, or catcher 32, or upon expiration of a pre-determined wait time without actual arrival of plunger 34.

Controller 50 monitors a plurality of "event-values" during operation of system 10, and in particular at the three specific calling-event periods during cycle of the plunger through the tubing. Certain event-values are particular to the calling-event for which it is associated. For example, upon the opening calling event (opening of valve 44) controller 50 may calculate the total shut-in time of the well and/or the net shut-in time which is the total shut-in time less the time for plunger 34 to return to the bottom of tubing 26. An example of a closing event value is total after-flow minutes. In step 100, threshold values may be input for each of the desired and available event-values based on the believed optimized operation of plunger system 10. Upon crossing a threshold value, controller 50 will operate valve 44 according to the preset instruction. An event-value corresponding to the calling-event of opening the valve is referred to as an "open trigger." An event-value corresponding to the calling-event of closing the valve is referred to as a "close trigger."

The present invention provides self-adjusting triggers, wherein controller 50 will adjust the preset value for the trigger threshold upon determination that the associated event-value satisfied the set condition for adjustment. Various self-adjusting triggers may be utilized to optimize well operations.

For example a load factor percentage or the like may be selected as a self-adjusting open trigger. Load factor is defined herein to be the shut-in casing pressure 24 minus the shut-in tubing pressure 30 divided by the shut-in casing pressure 26 minus the sales-line pressure 46, at the time of opening valve 44. When the well is first shut-in, the load factor should be close to 100 percent as the tubing pressure is close to the sales line pressure. During shut-in, the tubing pressure increases toward the value of the casing pressure. The rate of increase depends on the liquid load at the bottom of the wellbore. If there is no liquid, the tubing pressure will "catch" the casing pressure rather quickly. When the tubing pressure is half way between the values of the casing pressure and the sales line pressure, the load factor is 50 percent. It has been recognized that for standard casing and tubing diameters, the load factor should be below approximately 40 to 50 percent for plunger 34 to be raised to the surface. Thus, the user in step 100 may set a threshold value for this self-adjusting open trigger at a set percentage of the load factor or a window of values. Upon opening of valve 44, controller 50 receives electrical signals from transducers 24, 26 and 46 and calculates the load percentage. Controller 50 then evaluates the load percentage at opening to the threshold value. Once the threshold value is crossed, controller 50 opens valve 44.

Another example of a self-adjusting open trigger is tubing pressure rate of change (TPROC). The TPROC is the measured change of tubing pressure (24) over time when valve 44 is closed. Controller 50 monitors tubing pressure 24 and obtains a tubing pressure versus time slope. In step 100 of routine 52, the user or operator inputs a threshold value at which it is deemed to no longer be beneficial to keep the well shut-in. Upon controller 50 determining that the monitored TPROC slope crosses below the preset threshold value, controller 50 will actuate valve 44 to the open position. Controller 50 will then determine if the preset criteria or conditions for adjusting open trigger TPROC by the pre-set correction values have been satisfied.

An example of a self-adjusting close trigger is for a calculated critical flow rate. The critical flow rate is defined as the flow rate at which the drag force of the gas (upward in tubing 26) equals the weight of the liquid droplets, thereby suspending the droplets. The Coleman method may be used for tubing pressure under 1,000 psig and the Turner method may be utilized for tubing pressure greater than 1,000 psig. The threshold value for the self-adjusting trigger may be set at a percentage of the calculated critical flow rate.

In step 100, a threshold value for each of these self-adjusting triggers is input. The user further inputs the conditions or parameters for adjusting the threshold value. For example, the conditions may correspond to event-values measured at the various calling-events. Various parameters include, without limitation, net shut-in minutes, total shut-in minutes, casing pressure at opening, tubing pressure at opening, casing-tubing differential pressure at opening, casing-sales line differential pressure at opening, tubing-sales line differential pressure at opening, load factor percentage at opening, casing pressure increase rate at opening, sales meter orifice differential pressure at closing, casing pressure increase percentage at closing, afterflow minutes, actual flow rate versus critical flow rate at closing, flow rate at closing, actual flow rate as a percentage of critical flow rate, plunger velocity, and plunger arrival types. Plunger arrival types include non-arrival, vent assisted arrival, and unassisted arrival. For the input conditions, a value or condition for arrivals is input and modifying instructions are provided. Modifying instructions include without limitation, equal to, less than, greater than, not equal to, etc. The modifying instructions may further include instructions regarding calculating the modifying condition for a set number of cycles.

Routine 52 may further provide for user input of maximum and or minimum threshold value windows for adjustment. For example, the original threshold value will not be adjusted to exceed the maximum threshold value or decremented below the minimum threshold value.

Figure 3:
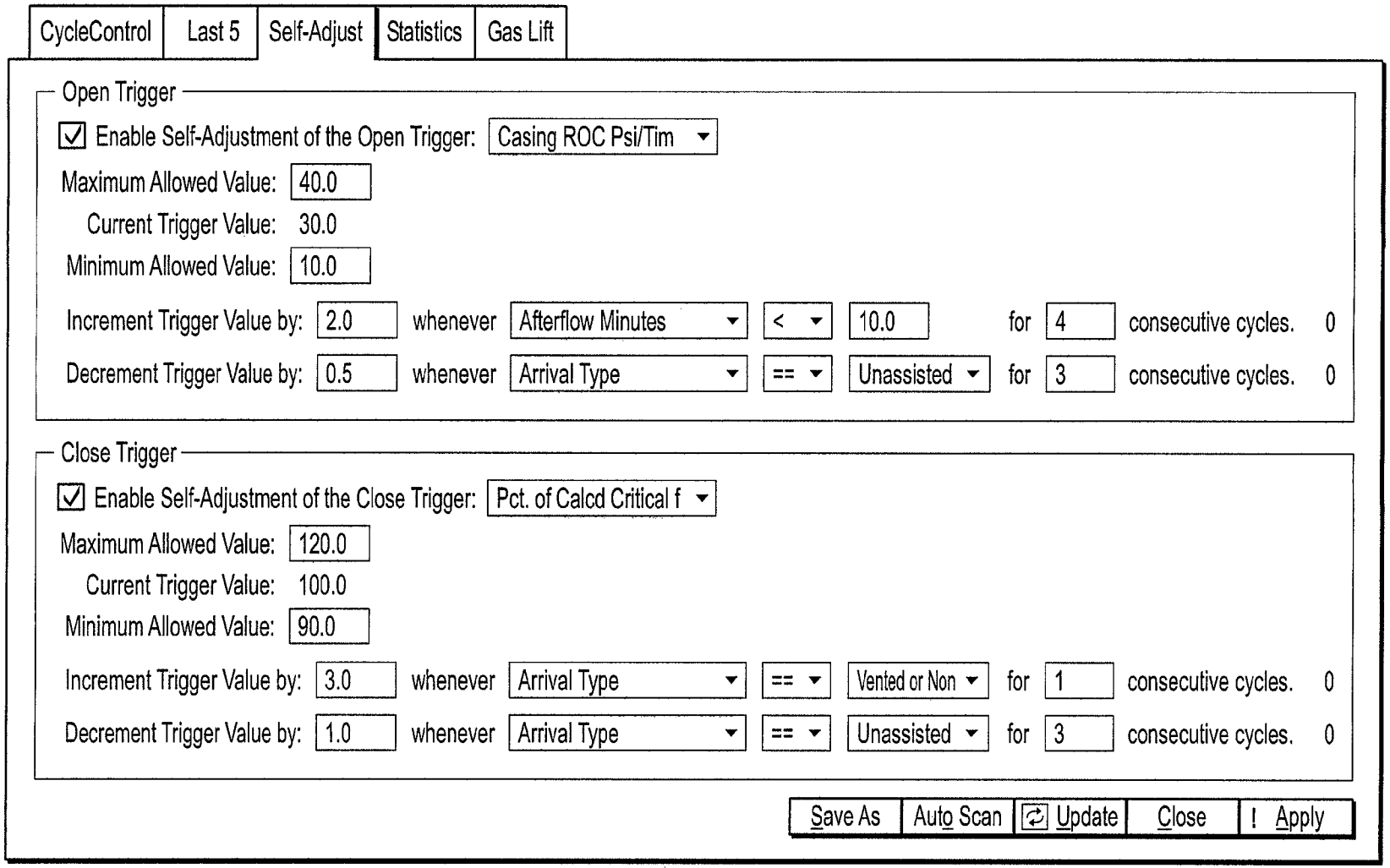
FIG. 3 is an example of a screen shot for inputting data into the routine for operation of the process illustrated in FIGS. 2A and 2B.

FIG. 3 is an example of a screen shot illustrating an example of routine 52 and the process of FIGS. 2A and 2B. In step 100, the user inputs into controller 50 data deemed to be appropriate for optimized production of the well. In a first step, the user selects whether to have self-adjustment of an "open trigger" and selects the self-adjustment open trigger. In the example of FIG. 3 self-adjustment of the open trigger of casing pressure rate of change over time is selected. The user then sets the current desired threshold value for triggering opening of the valve, shown as "30". The user then selects the adjustment factor to the threshold value and the conditions upon which adjustment is to occur. In the example of FIG. 3, the user inputs that the threshold value is to be incremented by 2 whenever the afterflow minutes are less than 10 for 4 consecutive cycles. The user has also instructed that controller 50 decrement the threshold value by 0.5 whenever the arrival type is unassisted for 3 consecutive cycles. Additionally, the user has input a maximum and minimum threshold value at which point adjustment of the threshold value ceases.

In the bottom half of FIG. 3, the user selects and inputs data for a self-adjusting close trigger. In this example, the user inputs data for self-adjusting the actual flow rate as a percentage of the calculated critical flow rate.

Once the self-adjusting triggers, threshold values, adjustment factors, conditions for adjustment, and maximum and minimum threshold values are input, routine 52 and operation of plunger lift system 10 are initiated. Controller 50 and routine 52 substantially continuously receive signals, measure data, and calculate conditions. Self-adjustment routine 52 calls at each of the calling-events: valve 44 opening; plunger 34 arrival (non-arrival, vented arrival, unassisted arrival); and valve 44 closing. Upon each calling-event, routine 52 determines if self-adjustment of an open trigger is enabled, step 102, and if self-adjustment of a close trigger is enabled, step 110. For each enabled self-adjusting open trigger, routine 52 and controller 50 process steps 102, 104, 106, 107, 108, and 120, 122, 124, 126, 128, 130. For each enabled self-adjusting close trigger, routine 52 and controller 50 process steps 110, 112, 114, 116, 118 and 120, 122, 124, 126, 128, 130.

Figure 4:
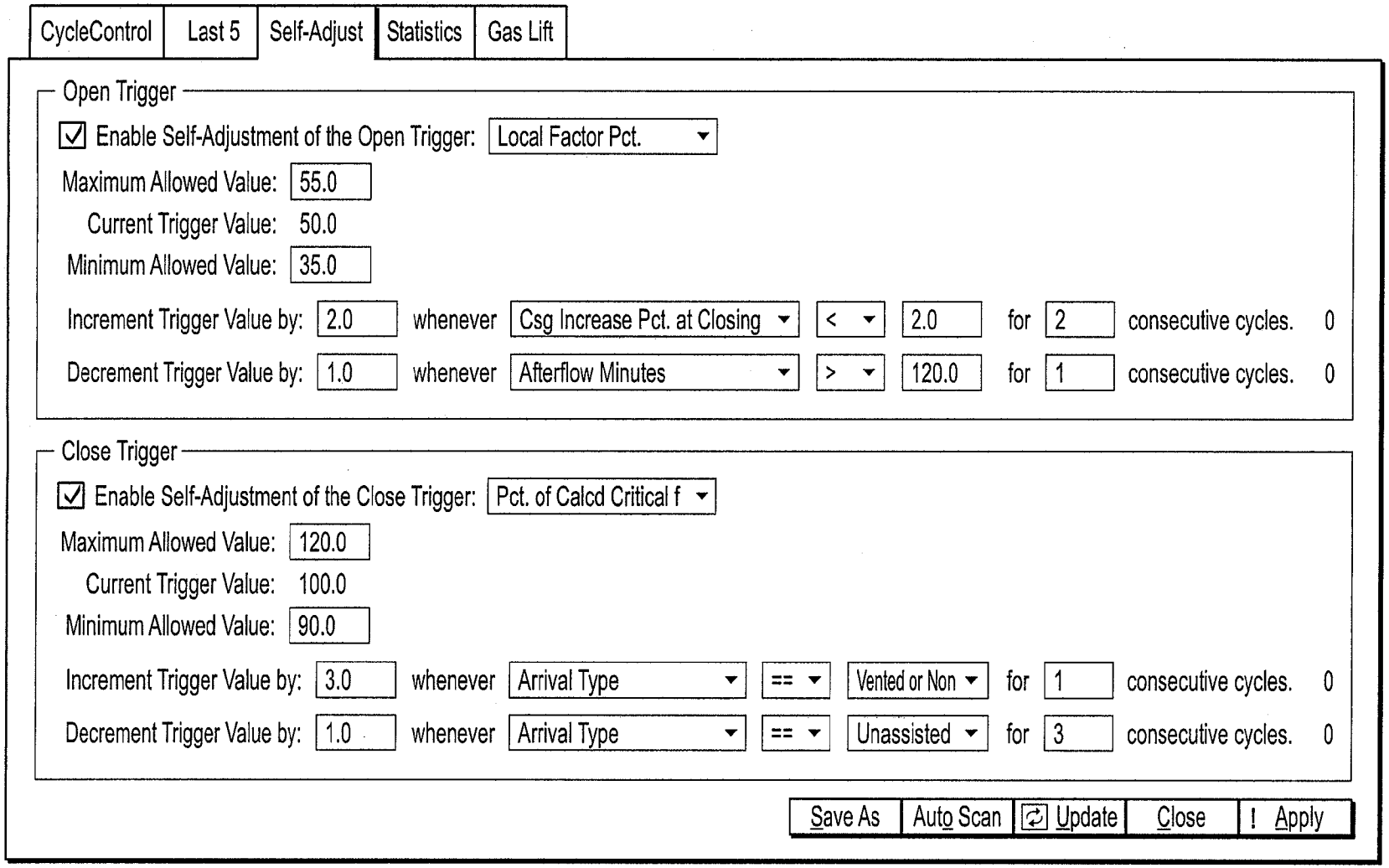
FIG. 4 is another example of a screen shot for inputting data into the routine for operation of the process illustrated in FIGS. 2A and 2B.

FIG. 4 is an example of a screen shot of an example of routine 52 and the process of FIGS. 2A and 2B. In step 100, a user inputs data deemed to be appropriate for optimized production of the well. In a first step, the user selects whether to have self-adjustment of an "open trigger" and selects the single self-adjustment open trigger. In the example of FIG. 4, self-adjustment of the open trigger "load factor" is selected. The user has set the current threshold value for triggering the opening of the well, shown here as "50". The user then selects the criteria for making adjustments to the threshold value by configuring a conditional statement (event-value conditions) that is examined at the appropriate time (calling event). In the example of FIG. 4, the user inputs that the load factor percentage (threshold value) is to be incremented by 2 whenever the casing pressure increase percentage (from its lowest value during afterflow) at closing, is less than 2 percent for 2 consecutive cycles. This statement is examined, and an adjustment made, if necessary, at each normal valve closing. The user has also instructed that controller 50 decrement the trigger threshold value by 1 whenever the afterflow minutes (examined at each normal valve closing) is greater than 120. Additionally, the user has input a maximum threshold value of 55 and a minimum threshold value of 35. If the threshold value reaches either of these values, no further adjustment is allowed in that direction.

In the bottom half of FIG. 4, the user selects and inputs data for the self-adjusting close trigger. In the example of FIG. 4, the self-adjustment close trigger, "percentage of calculated critical flow", is selected. The current threshold value for triggering the closing of the well is shown in this example as "100". The user then selects the criteria for making adjustments to the threshold value by configuring a conditional statement (event-value conditions) that is examined at the appropriate time (calling event). In the example of FIG. 4, the user inputs that the percentage of calculated critical flow (threshold value) is to be incremented by 3 whenever the plunger arrival type is "vented" or "non-arrival". This statement is examined, and an adjustment made, if necessary, at each plunger arrival (or end of plunger wait period for a non-arrival). The user has also instructed that controller 50 decrement the trigger threshold value by 1 whenever the plunger arrival type is "unassisted".

From the foregoing detailed description of specific embodiments of the invention, it should be apparent that a system for controlling a plunger lift system that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A method of controlling a plunger lift system for a well and adjusting an operational threshold, the plunger lift system having a tubing positioned in a cased well, a plunger in the tubing moveable from the bottom of the tubing to a top of the tubing, a control valve in functional connection with the tubing, a plunger arrival sensor, a tubing pressure sensor, a casing pressure sensor, and a sales line pressure sensor, a controller in operational connection with the control valve and functional connection with the sensors for receiving signals from the sensors, the method comprising the steps of:

defining a threshold value for a trigger event the trigger event initiating operation of the control valve by the controller, wherein the trigger event is a rate of change of tubing pressure over time;

defining an event-value condition upon which adjustment of the threshold value is adjusted;

determining, upon a calling-event, if the event-value condition has been satisfied; and adjusting the threshold value by an adjustment factor upon satisfaction of the event-value condition.

2. The method of claim 1, wherein the trigger event initiates opening the control valve.

3. The method of claim 1, wherein the trigger event initiates closing the control valve.

4. The method of claim 1, wherein the calling-event is plunger arrival.

5. The method of claim 4, wherein the plunger arrival includes arrival of the plunger at the top of the tubing and non-arrival of the plunger at the top of the tubing after a predetermined wait time.

6. The method of claim 1, wherein the calling-event includes opening the control valve, closing the control valve, plunger arrival and non-arrival of the plunger after a predetermined wait time.

7. The method of claim 1, wherein the event-value is selected from one of net shut-in time, total shut-in time, casing pressure, tubing pressure, casing-tubing differential pressure, casing-sales line differential pressure, tubing-sales line differential pressure, load factor percentage, rate of casing pressure increase, actual flow rate versus critical flow rate, plunger velocity, and plunger arrival type.

8. A method of controlling a plunger lift system for a well and adjusting an operational threshold, the plunger lift system having a tubing positioned in a cased well, a plunger in the tubing moveable from the bottom of the tubing to a top of the tubing, a control valve in functional connection with the tubing, a plunger arrival sensor, a tubing pressure sensor, a casing pressure sensor, and a sales line pressure sensor, a controller in operational connection with the control valve and functional connection with the sensors for receiving signals from the sensors, the method comprising the steps of:

defining a threshold value for a load factor percentage at which threshold value the control valve will be operated to an open position, wherein the load factor percentage is the shut-in casing pressure minus the shut-in tubing pressure divided by the shut-in casing pressure minus the sales-line pressure;

opening the control valve upon the threshold value being obtained;

defining an event-value condition upon which adjustment of the threshold value is adjusted;

determining, upon a calling-event, if the event-value condition has been satisfied; and adjusting the threshold value by an adjustment factor upon satisfaction of the event-value condition.

9. The method of claim 8, wherein the adjustment factor is predetermined.

10. A method of controlling a plunger lift system for a well and adjusting an operational threshold, the plunger lift system having a tubing positioned in a cased well, a plunger in the tubing moveable from the bottom of the tubing to a top of the tubing, a control valve in functional connection with the tubing, a plunger arrival sensor, a tubing pressure sensor, a casing pressure sensor, and a sales line pressure sensor, a controller in operational connection with the control valve and functional connection with the sensors for receiving signals from the sensors, the method comprising the steps of:

defining a threshold value for a calculated critical flow rate at which threshold value the control valve will be operated to a closed position;

opening the control valve upon the actual flow rate crossing the threshold value;

defining an event-value condition upon which adjustment of the threshold value is adjusted;

determining, upon a calling-event, if the event-value condition has been satisfied; and adjusting the threshold value by an adjustment factor upon satisfaction of the event-value condition.

11. The method of claim 10, wherein the adjustment factor is predetermined.

12. The method of claim 10, further including the steps of:

defining a load factor threshold value for a load factor percentage at which the control valve will be operated to an open position, wherein the load factor percentage is the shut-in casing pressure minus the shut-in tubing pressure divided by the shut-in casing pressure minus the sales-line pressure;

opening the control valve upon the load factor threshold value being obtained;

defining a load factor event-value condition upon which adjustment of the load factor threshold value is adjusted;

determining, upon a load factor calling-event, if the load factor event-value condition has been satisfied; and adjusting the load factor threshold value by an adjustment factor upon satisfaction of the load factor event-value condition.

13. The method of claim 10, wherein the threshold value is the actual flow rate as a percentage of the calculated critical flow rate.

14. The method of claim 13, wherein the critical flow rate is the flow rate at which the drag force of the gas traveling upward in the tubing equals the weight of the liquid droplets in the tubing.

15. The method of claim 10, wherein the critical flow rate is the flow rate at which the drag force of the gas traveling upward in the tubing equals the weight of the liquid droplets in the tubing.

* * * * *